US006971934B1

(12) United States Patent
Parks

(10) Patent No.: US 6,971,934 B1
(45) Date of Patent: Dec. 6, 2005

(54) AUTONOMOUS LIQUID FILLED BUOY

(75) Inventor: Bruce Carl Parks, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/022,471

(22) Filed: Dec. 22, 2004

(51) Int. Cl.[7] ..... B63B 22/20
(52) U.S. Cl. ..... 441/29; 441/21
(58) Field of Search ..... 441/1, 2, 21–29; 114/25

(56) References Cited

U.S. PATENT DOCUMENTS 3,228,369 A * 1/1966 Warhurst et al. ..... 114/331
3,465,374 A * 9/1969 Johnson et al. ..... 441/4
5,379,267 A * 1/1995 Sparks et al. ..... 367/18

* cited by examiner

*Primary Examiner*—Ed Swinehart
(74) *Attorney, Agent, or Firm*—Peter A. Lipovsky; Michael A. Kagan; Allan Y. Lee

(57) ABSTRACT

A buoy system includes a sea-bed pump station having separate reservoirs of lighter-than-water and heavier-than-water liquids. The reservoirs are in fluid communication with peristaltic pumps that are operated via a preprogrammed control within the station. A buoy has an upper chamber connected by umbilical to be in fluid communication with the lighter-than-water chamber of the pump station and also includes a lower chamber connected to be in fluid communication with the heavier-than-water chamber of the station. The sea-bed and buoy chambers for the heavier-than-water liquid are both gimbaled mounted to assist fluid transfer even when non-level. Selected venting at the sea-bed pump station and of the buoy permit sea flooding and pressure equalization.

8 Claims, 2 Drawing Sheets

AUTONOMOUS LIQUID FILLED BUOY

BACKGROUND

This invention relates generally to buoys and more specifically, but without limitation thereto, to buoys that rise to a sea surface and descend therefrom upon command.

Various designs have been proposed and implemented to raise and lower buoys based upon an intentional exchange of fluids. Designs wherein buoys are purposely flooded and purged typically require a myriad of complex valves and check valves to ensure proper flow of the utilized liquids.

There is a need for a buoy system that employs a relatively simple technique of flooding and purging a buoy upon command.

SUMMARY

A buoy system includes a sea-bed pump station having a first reservoir-housing containing a lighter-than-water liquid that is in fluid communication with a first motor-driven peristaltic pump. The pump station also has a second reservoir-housing that includes a funnel-shaped gimbaled mounted interior chamber for a heavier-than-water liquid. The interior chamber of the second reservoir-housing is in fluid communication with a second motor-driven peristaltic pump. The pump station also includes a control for selectively operating said first and second motor-driven peristaltic pumps.

A buoy is connected by an umbilical to the sea-bed pump station and has an upper chamber in fluid communication with the first motor-driven peristaltic pump and the lighter-than-water chamber of the pump station. The buoy also includes a lower chamber separated from the upper chamber. Within this lower chamber is a funnel-shaped gimbaled mounted interior chamber for the heavier-than-water liquid. This interior chamber is connected through the umbilical to the sea bed pump station and is in fluid communication with the second motor-driven peristaltic pump and the heavier-than-water gimbaled-mounted chamber of the pump station. Selected venting at the sea-bed pump station and of the buoy permit sea flooding and pressure equalization.

The pump control is programmable to permit desired flooding and purging of the buoy with the lighter-than-water or heavier-than-water liquids as needed. The gimbal mounted chambers assist in this transfer even when the associated sea-bed housing or buoy is non-level.

Other objects, advantages and features of the invention will become apparent from the following description when taken in conjunction with the accompanying drawings.

DESCRIPTION

Figure 1:
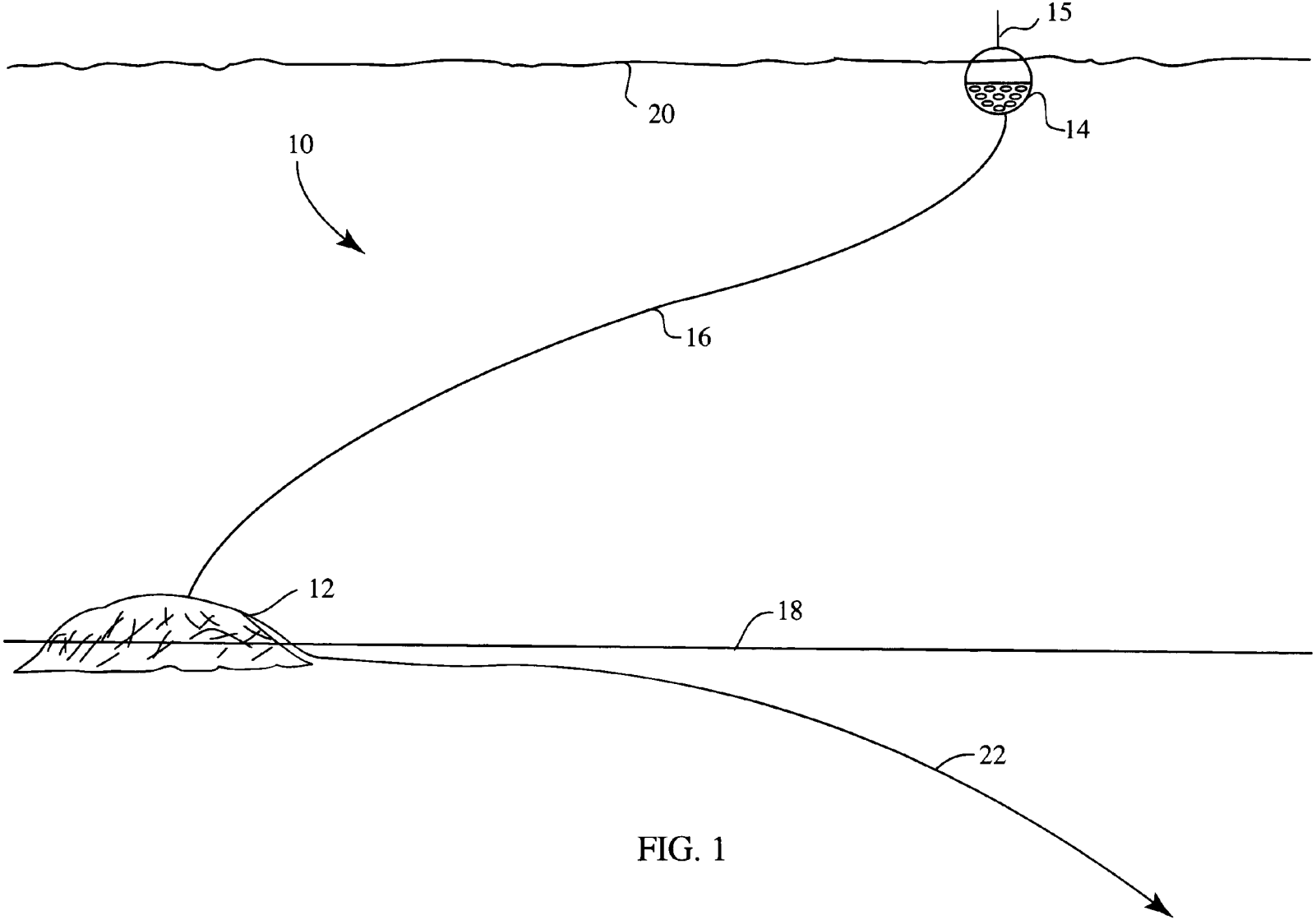
FIG. 1 shows a side view of a deployment of a buoy system according to the description herein, the utilized buoy being shown in a surface position.

Referring to FIG. 1, a buoy system 10 is shown. System 10 includes a sea-bed pump station 12 and a buoy 14 operably connected to pump station 12 by way of an umbilical 16. Pump station 12 is shown placed on a sea-bed floor 18 such as that found at the bottom of any of a variety of water bodies such as a sea, lake or ocean. Buoy 14 is depicted in this figure raised to surface 20. Buoy 14 can be equipped with an on-board antenna 15 suitable for sending and receiving transmissions when the buoy is surfaced. These signals can be transferred via appropriate conductor(s) made a part of umbilical 16 that can further be connected to a distant sensor array by way of link 22.

Figure 2:
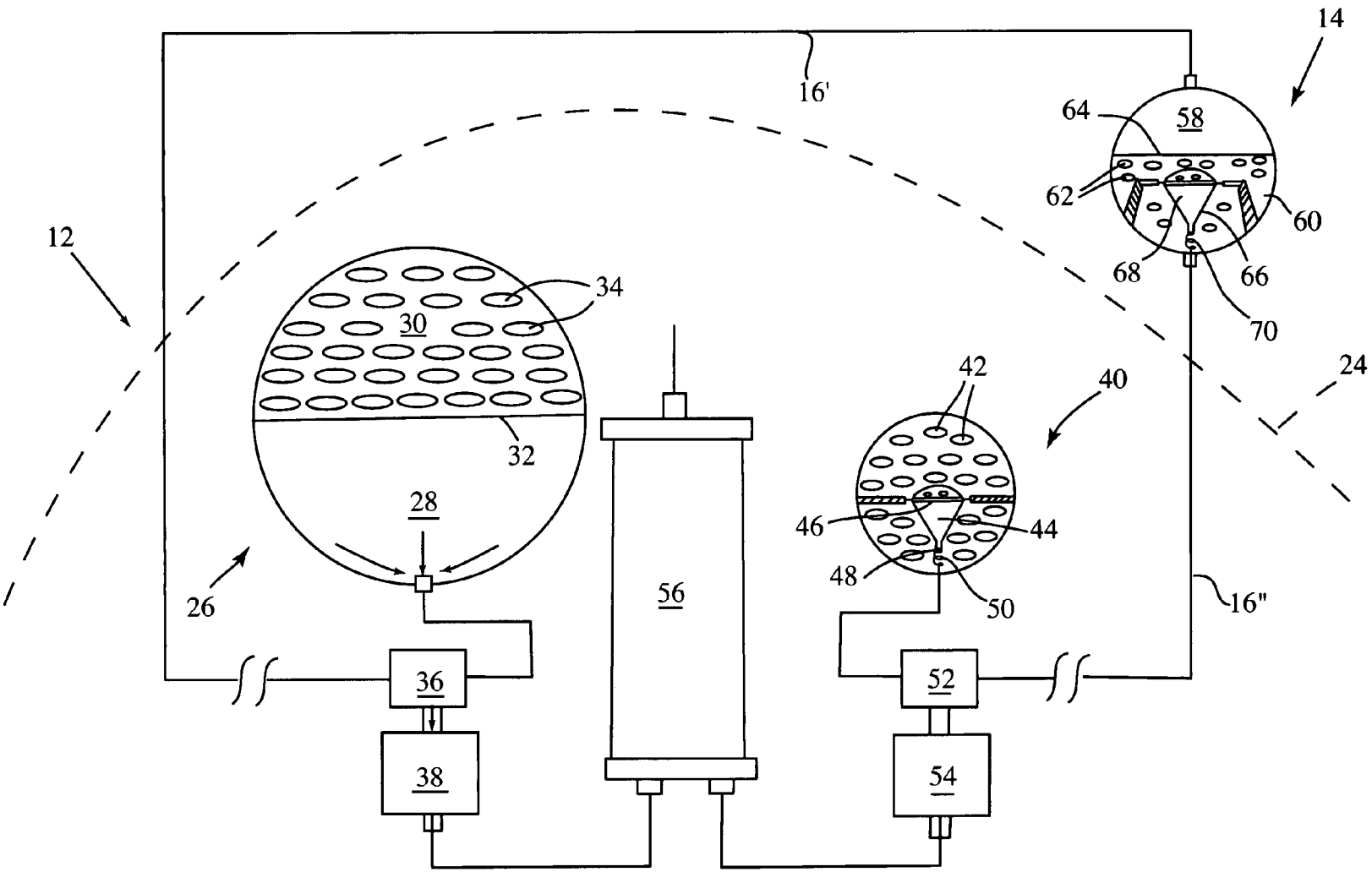
FIG. 2 is a detailed view of the system shown in FIG. 1 wherein an associated buoy is submerged.

Referring to FIG. 2, a detailed view of system 10 is shown wherein buoy 14 is in a submerged position. Buoy 14 is raised or lowered by changing the buoyancy of the buoy. Positive or negative buoyancy is accomplished by changing the specific gravity of the liquid in the buoy while maintaining a constant liquid volume at ambient underwater pressure.

Pump station 12 is surrounded by a protective dome 24, such as one made of a high-impact composite material, to shield and protect the interior contents of the pump station from trawling nets, etcetera. Dome 24 is vented to the sea for pressure equalization.

Under this dome is a first reservoir-housing 26. Reservoir-housing 26 has two chambers, one of these chambers 28 being on one side of housing 26 and a second chamber 30 on another side of the housing. The two chambers are separated by a flexible membrane 32. Chamber 30 has vent openings 34 that permit the underwater environment to enter this chamber and thereby equalize the pressure outside and inside of chamber 30. Chamber 28 permits the holding of a lighter-than-water liquid, such as diesel fuel, that can drained from and alternatively placed back within chamber 28 upon pre-programmed commands.

To assist in this fluid transfer, a reversible peristaltic pump 36 with a suitable driver 38 is employed. Such a pump and driver is available through Cole-Parmer Instrument Company, 625 E. Bunker Court, Vernon Hills, Ill. 60061-1844, see pump Part No. 7725062.

By using such a reversible pump, the need for complex valves and check valves to accomplish two-way flow is eliminated. The motor drive utilized with the peristaltic pump is placed within a pressure vessel wherein the motor's drive shaft is fitted through the vessel wall and is sealed in a suitable manner such as by underwater shaft packing and/or "O" ring seals.

Additionally fitted under dome 24 is a second reservoir-housing 40 that is fully-vented to the underwater environment such as by vent openings 42. Within second reservoir-housing 40 is a funnel-shaped gimbaled mounted interior chamber 44 for a heavier-than-water liquid, such as mercury. This interior chamber funnel has a large open-end where mounted. The large end is covered with a flexible membrane 46 designed to interface with the sea environment and that can be further supplied with a protective vented dome top, as shown. Opposite the large end of chamber 44 is a small open-end 48 that is connected to a small diameter, high-pressure and flexible hydraulic hose 50, shown coiled, that puts the contents of interior chamber 44 in fluid communication with a second reversible motor-driven peristaltic pump 52, like the first described above. Second peristaltic pump 52, like first peristaltic pump 36, eliminates the need for complex valves and check valves otherwise required for two-way fluid flow. Motor drive 54 for peristaltic pump 52 is placed within a pressure vessel and, as in the first application, has its drive shaft fitted through the wall of the vessel where it is sealed in a suitable manner such as by underwater shaft packing and/or "O" ring seals.

Also contained under shield 24 is a pump control 56 having a pressure vessel outer housing containing therein suitable battery power and electronics to control the operation of pumps 36 and 52 so that buoy 14 can be raised and lowered within the sea as desired.

Referring now to the particulars of buoy 14, buoy 14 has an upper chamber 58 that by way of umbilical subset 16' is in fluid communication with the lighter-than-water liquid chamber 28 of first reservoir-housing 26.

Buoy 14 also has a lower chamber 60 that is vented to the undersea environment by vent-openings 62 and that is separated from upper chamber 58 by flexible membrane 64. Within this lower chamber 60 is a funnel-shaped gimbaled-mounted interior chamber 66, like interior chamber 44, that is designed to hold the heavier-than-water liquid used in system buoy system 10. Interior chamber 66 includes a large open-end where mounted that is covered with a flexible membrane 68 designed to interface with the sea environment and that can be further supplied with a protective vented dome top, as shown. Opposite the large end of chamber 66 is a small open-end that is connected to a small diameter high-pressure and flexible hydraulic hose 70, shown coiled, that via umbilical 16" puts the contents of interior chamber 66 into fluid communication with second reversible motor-driven peristaltic pump 52 and hence the interior of interior chamber 44 of second reservoir-housing 40.

To sink buoy 14, diesel fuel, for example, present in upper chamber 58 of buoy 14, is pumped from the buoy and into chamber 28 of first reservoir-housing 26, lying on the sea-bed. Mercury, for example, can then be pumped into buoy 14's interior chamber 66, which, even while making its way to the buoy, will cause a gradual sinking and submergence of the buoy. Raising the buoy will be the reverse of this. During a raising maneuver, chamber 58 gradually fills with the diesel fluid and seawater is displaced from the buoy by dispelling the seawater through the vent-openings 62 in the lower part of the buoy. Conversely, of course, as the lighter-than-water liquid is pumped from buoy 14, seawater will automatically flood the buoy through the vent-openings. The buoy can, for example, be constructed of a composite and anechoic material and be completely liquid filled, having no airspace or foam.

Pump control 56 can have programmable capability so that buoy 14 can be programmed to rise to the surface at specific times and/or intervals. Wherein buoy 14 is equipped with an antenna for data transmission and reception, one can envision that it is possible to download local almanac data to the antenna to be loaded into memory within pump control 56. Such data as sunrise/sunset, tidal and fluid current information can be used to allow the buoy to rise and then be returned to the deep under desired conditions. Pump control 56 can also be equipped with an acoustically-activated default program wherein acoustic sensors within the control can cause buoy 14 to rapidly submerge in the event of a possible surface collision and the like of the buoy with a surface craft.

For both the buoy and the sea-bed pump station, the gimbaled cone-shaped chambers used for heavier-than-water fluids permits the fluid within these chambers to be drawn out even when the buoy or chamber is laying at an angle. The buoy design allows the buoy to remain upright at the sea-surface, making it a logical platform for an antenna. It can also be designed to lay low in the water, creating a minimal visual obstruction.

If it is desired to completely purge the buoy of the utilized heavier-than-water liquid, this can be done by floating a small amount of distilled water or light oil on top of the heavier-than-water liquid, separating it from the cone-shaped chamber's membrane. When the buoy is purged of the heavy liquid, the distilled water (or light oil) will be drawn part way down the umbilical but will be clear of the buoy.

Obviously, many modifications and variations of the invention are possible in light of the above description. It is therefore to be understood that within the scope of the claims the invention may be practiced otherwise than as specifically described.

What is claimed is:

1. A buoy system comprising:

a sea-bed pump station, said pump station including a first reservoir-housing having two-chambers, one said chamber for a lighter-than-water liquid and being in fluid communication with a first motor-driven peristaltic pump, said first reservoir-housing having a flexible membrane between said one chamber and a second chamber thereof wherein said second chamber defines openings therein for communication with a sea environment;

a second reservoir-housing having an exterior defining openings therein for communication with said sea environment and having a funnel-shaped gimbaled mounted interior chamber for a heavier-than-water liquid, said interior chamber including a large open-end where mounted and a small open-end distal from said large open-end in fluid communication with a second motor-driven peristaltic pump, said large end of said funnel shaped interior chamber being covered with a flexible membrane for interfacing with said sea environment; and a control for selectively operating said first and second motor-driven peristaltic pumps;

a buoy having a upper chamber operably connected to said first motor-driven peristaltic pump and in fluid communication with said one chamber of said first reservoir-housing, said buoy having a lower chamber separated from said upper chamber by a flexible membrane, said lower chamber defining openings therein for communication with a sea environment and having therein a funnel-shaped gimbaled mounted interior chamber for said heavier-than-water liquid and being operably connected to said second motor-driven peristaltic pump and in fluid communication with said interior chamber of said second reservoir-housing, said interior chamber including a large open-end where mounted and a small open-end distal from said large open-end in fluid communication with said second motor-driven peristaltic pump, said large end of said funnel shaped interior chamber being covered with a flexible membrane for interfacing with said sea environment;

a quantity of said lighter-than-water liquid for transfer between said one chamber of said first reservoir and said upper chamber of said buoy; and a quantity of said heavier-than-water liquid for transfer between said interior chamber of said second reservoir-housing and said interior chamber of said buoy.

2. The buoy system of claim 1 wherein said lighter-than-water liquid is diesel fuel.

3. The buoy system of claim 1 wherein said heavier-than-water liquid is mercury.

4. The buoy system of claim 1 wherein said sea-bed pump station has a dome-shield enclosure.

5. The buoy system of claim 1 wherein said control is pre-programmed for selectively operating said first and second motor-driven peristaltic pumps in a pre-programmed mode.

6. A buoy system comprising:

a sea-bed pump station, said pump station including a first reservoir-housing having two-chambers, one said chamber for diesel fuel and being in fluid communication with a first motor-driven peristaltic pump, said first reservoir-housing having a flexible membrane between said one chamber and a second chamber thereof wherein said second chamber defines openings therein for communication with a sea environment;

a second reservoir-housing having an exterior defining openings therein for communication with said sea environment and having a funnel-shaped gimbaled mounted interior chamber for liquid mercury, said interior chamber including a large open-end where mounted and a small open-end distal from said large open-end in fluid communication with a second motor-driven peristaltic pump, said large end of said funnel shaped interior chamber being covered with a flexible membrane for interfacing with said sea environment; and a control for selectively operating said first and second motor-driven peristaltic pumps;

a buoy having a upper chamber operably connected to said first motor-driven peristaltic pump and in fluid communication with said one chamber of said first reservoir-housing, said buoy having a lower chamber separated from said upper chamber by a flexible membrane, said lower chamber defining openings therein for communication with a sea environment and having therein a funnel-shaped gimbaled mounted interior chamber for said liquid mercury and being operably connected to said second motor-driven peristaltic pump and in fluid communication with said interior chamber of said second reservoir-housing, said interior chamber including a large open-end where mounted and a small open-end distal from said large open-end in fluid communication with said second motor-driven peristaltic pump, said large end of said funnel-shaped interior chamber being covered with a flexible membrane for interfacing with said sea environment;

a quantity of said diesel fuel for transfer between said one chamber of said first reservoir and said upper chamber of said buoy; and a quantity of said liquid mercury for transfer between said interior chamber of said second reservoir-housing and said interior chamber of said buoy.

7. The buoy system of claim 6 wherein said sea-bed pump station has a dome-shield enclosure.

8. The buoy system of claim 6 wherein said control is pre-programmed for selectively operating said first and second motor-driven peristaltic pumps in a pre-programmed mode.

* * * * *